US011834929B2

(12) United States Patent
Bruandet

(10) Patent No.: US 11,834,929 B2
(45) Date of Patent: Dec. 5, 2023

(54) DOWN THE HOLE DRILLING ASSEMBLY AND APPARATUS

(71) Applicant: SANDVIK MINING AND CONSTRUCTION OY, Tampere (FI)

(72) Inventor: Olivier Bruandet, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 246 days.

(21) Appl. No.: 17/619,300

(22) PCT Filed: Jun. 18, 2020

(86) PCT No.: PCT/EP2020/066859
§ 371 (c)(1),
(2) Date: Dec. 15, 2021

(87) PCT Pub. No.: WO2020/254457
PCT Pub. Date: Dec. 24, 2020

(65) Prior Publication Data

US 2022/0298864 A1 Sep. 22, 2022

(30) Foreign Application Priority Data

Jun. 20, 2019 (EP) ..... 19181471

(51) Int. Cl.
*E21B 4/14* (2006.01)
*E21B 21/18* (2006.01)

(52) U.S. Cl.
CPC ..... *E21B 4/14* (2013.01); *E21B 21/18* (2013.01)

(58) Field of Classification Search
None
See application file for complete search history.

(56) References Cited

U.S. PATENT DOCUMENTS 3,480,088 A * 11/1969 Ghelfi ..... E21B 4/14 173/78
3,692,122 A * 9/1972 Curington ..... E21B 4/14 173/136
3,735,820 A * 5/1973 Curington ..... E21B 4/14 173/78
7,784,561 B2 * 8/2010 Lim ..... E21B 4/14 173/13
8,302,707 B2 11/2012 Lyon et al.
8,622,152 B2 * 1/2014 Lyon ..... E21B 4/14 175/135
2002/0011360 A1 * 1/2002 Gien ..... E21B 4/14 173/135
2010/0187017 A1 * 7/2010 Lyon ..... E21B 21/16 173/125

(Continued)

FOREIGN PATENT DOCUMENTS

CL 200100686 5/2002
EP 3409878 A1 12/2018

(Continued)

*Primary Examiner* — Kipp C Wallace
(74) *Attorney, Agent, or Firm* — Corinne R. Gorski

(57) ABSTRACT

A down the hole drilling assembly having an elongate casing, a fluid powered piston, top and bottom working chambers, a plurality of fluid passages and an exhaust system, wherein the sum of the top work area and a top intermediate work area of the piston is equal to the cross-sectional area of the casing bore.

10 Claims, 4 Drawing Sheets

(56) References Cited

U.S. PATENT DOCUMENTS

| | | | | |
|---|---|---|---|---|
| 2010/0200301 | A1 | 8/2010 | Lyon et al. | |
| 2012/0006598 | A1 | 1/2012 | Lyon et al. | |
| 2016/0369565 | A1* | 12/2016 | Purcell | E21B 4/14 |

FOREIGN PATENT DOCUMENTS

| | | | |
|---|---|---|---|
| WO | 2018107305 | A1 | 6/2018 |
| WO | 2018220098 | A1 | 12/2018 |

* cited by examiner

DOWN THE HOLE DRILLING ASSEMBLY AND APPARATUS

RELATED APPLICATION DATA

This application is a § 371 National Stage Application of PCT International Application No. PCT/EP2020/066859 filed Jun. 18, 2020 claiming priority to EP 19181471.4 filed Jun. 20, 2019.

TECHNICAL FIELD

The present invention relates to a down-the-hole hammer drill bit assembly arranged to drive the piston with higher frequency and power output.

BACKGROUND

Holes can be drilled in rock by means of various rock drilling assemblies. Drilling may be performed with a method of combining percussions and rotation. This type of drilling is called percussive drilling. Percussive drilling may be classified according to whether an impact device is outside the drill hole or in the drill hole during drilling. When the impact device is in the drill hole, the drilling is typically called down the hole (DTH) drilling. Since the impact device in the DTH drilling assembly is located inside the drill hole, the structure of the impact device needs to be compact.

The technique of DTH percussive hammer drilling involves the supply of a pressurised fluid via a drill string to a hammer located at the bottom of a bore hole. The fluid acts to both drive the hammer drilling action and to flush chips and fines resultant from the cutting action, rearwardly through the bore hole so as to optimise forward cutting.

The drilling assembly is provided with a reciprocating percussion piston, which is moved by controlling the feeding and discharging of pressurized fluid into and out of working chambers where the working surfaces of the piston are located. The piston is configured to strike a drill bit being connected directly to the drilling assembly.

Traditionally, there would be a flushing hole in the centre of the piston to flush the top chamber. Patent application EP 3 409 878 describes an alternative drilling assembly which has a reciprocating percussion piston that is moved by controlling feeding and discharging pressurized fluid into and out of working chambers where the working surfaces of the piston are located. There is however still a need to provide a drilling assembly whereby the power output from the piston is increased, this will increase the efficiency of the drilling equipment which will result in cost savings.

SUMMARY

It is an objective of this invention to provide a novel and improved percussive drilling assembly and apparatus for drilling rock whereby the working areas of the piston are maximised to match the available area inside the casing bore.

The objective is achieved by providing a down the hole drilling assembly comprising: a down the hole drilling assembly having a top end arranged for coupling to a drill string and bottom cutting end. The drilling assembly comprising:

an elongate casing having an outer wall and an inner wall;

a bore housed within the inner wall of the casing having an inner bore diameter $D_1$;

a fluid powered piston arranged moveably inside the casing which is capable of shuttling axially back and forth. The piston having a central portion with a cross-sectional diameter $D_2$, a top end distal portion with a cross-sectional diameter $D_3$ and a bottom end distal portion with a cross-sectional diameter $D_4$;

a top working chamber arranged at the top end of the piston;

a bottom working chamber arranged at the bottom end of the piston;

a top control sleeve and bottom control sleeve arranged inside the casing;

a plurality of fluid passages located between the controls sleeves and the casing including: at least one main feed passage, at least one top feed passage and at least one bottom feed passage arranged to control the feeding of pressurized fluid into the top and bottom working chambers to generate the reciprocating movement of the piston;

at least one flushing port at the bottom end of the casing which is connected to at least one bottom vent passage arranged to exhaust the bottom chamber;

an exhaust system comprising at least one exhaust port and at least one exhaust passage at the top end of the casing arranged to exhaust the top chamber via at least one top vent passage; and an air distributor having at least a first fluid passage connecting an inlet port to the at least one main feed passage and a second fluid passage connecting the top vent passage with the at least one exhaust passage.

characterized in:

the piston having a top work area $W_1$ and a top intermediate work area $W_2$, wherein the cross-sectional area of the casing bore $A_{CB}$, is equal to the sum of the top work area $W_1$ and the top intermediate work area $W_2$:

$$W_1+W_2 \geq 0.99*A_{CB}$$

Preferably, the piston having a bottom work area $W_3$ and a bottom feed work area $W_4$, wherein a cross-sectional area of the casing bore $A_{CB}$ is equal to the sum of the bottom work area $W_3$ and the bottom feed work area $W_4$:

$$W_3+W_4 \geq 0.99*A_{CB}$$

This design means that sum of the surface areas exposed to pressure during the striking motion is equal to the surface area of the casing bore. The advantage of this design is that the full area available inside the casing bore is utilised to drive the piston. The increased working area has the effect of reducing the needed stroke length to accelerate the piston to the desired striking velocity thus enabling higher percussion frequency and power output and improving the efficiency of the drilling. Additionally, using a lower volume of air is beneficial in reducing the wear rate of the external components.

Preferably, the ratio of the diameters of the central portion to the two distal portions of the piston is such that:

$D_3$ is in the range $0.3*D_2$ to $D_2$; and $D_4$ is in the range $0.3*D_2$ to $D_2$.

Preferably, the ratio of the diameters of the central portion to the two distal portions of the piston is such that $D_3$ is in the range $0.3*D_2$ to $0.98*D_2$ and $D_4$ is in the range $0.3*D_2$ to $0.98*D_2$, preferably $D_3$ is in the range $0.5*D_2$ to $D_2$ and $D_4$ is in the range $0.5*D_2$ to $D_2$. Ratios in these ranges are preferred because if the difference between the diameters is too large high levels of stress are created which would result in a weak construction with poor efficiency.

Preferably, a top intermediate chamber is formed between the top end distal portion of the piston and the central portion of the piston, the top end distal portion of the piston being arranged at least partly inside the top control sleeve, and wherein the top intermediate chamber is in fluid connection with the inlet port through the at least one main feed passage.

Preferably, the top chamber being in fluid connection with the top intermediate chamber via the at least one top feed passage.

Preferably, where a bottom intermediate chamber is formed between the bottom end distal portion of the piston and the central portion of the piston, wherein the bottom end distal portion of the piston is arranged at least partly inside the bottom control sleeve, and wherein the bottom intermediate chamber is in fluid connection with the top intermediate chamber via at least one intermediate feed passage.

Preferably, the bottom intermediate chamber is in fluid connection with the bottom chamber via the at least one bottom feed passage.

Optionally, a check valve is arranged between the at least one exhaust port and the at least one exhaust passage.

Alternatively, the exhaust system is moveable axially and there is an exhaust valve which opens and closes the connection between the at least one exhaust passage and the at least one exhaust port when the drilling assembly switched from drilling to flushing modes respectively.

Another aspect of this invention relates to a drilling apparatus for percussive rock drilling comprising:

a drill string formed from a plurality of end-to-end coupled drill tubes; and a drilling assembly as claimed herein releasably attached at an axially forward end of the drill string.

BRIEF DESCRIPTION OF THE DRAWING

A specific implementation of the present invention will now be described, by way of example only, and with reference to the accompanying drawings in which.

DETAILED DESCRIPTION

Figure 1:
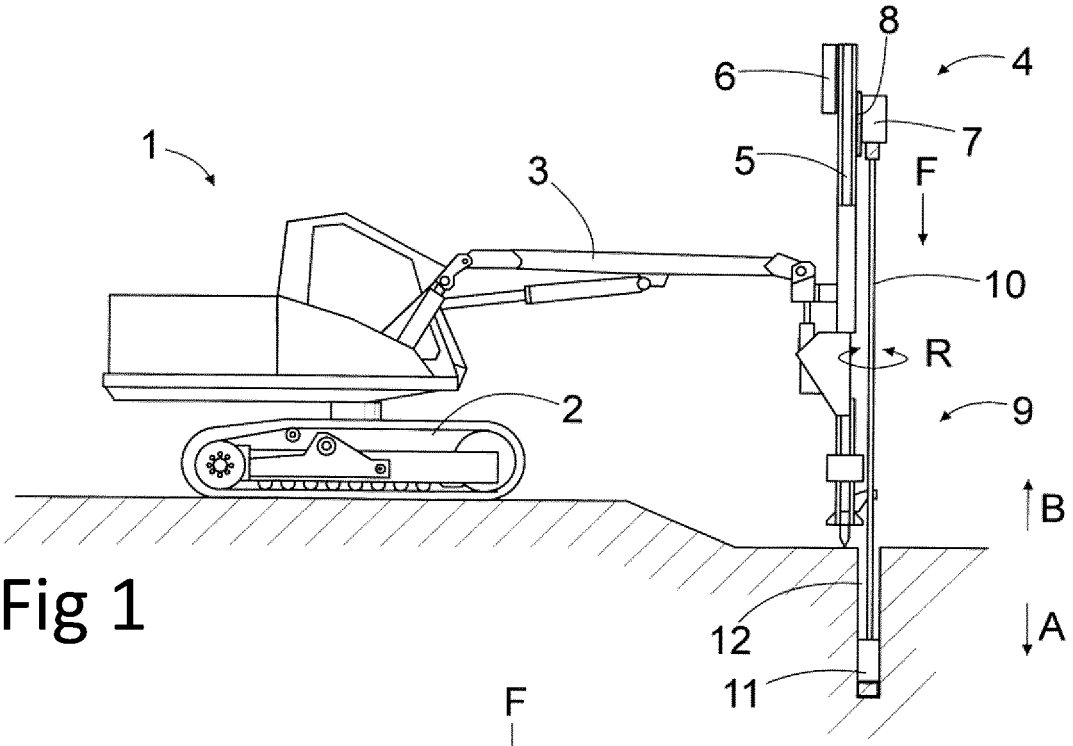
FIG. 1: shows a schematic drawing of a rock drilling rig provided with a DTH rock drilling assembly.

FIG. 1 shows a rock drilling rig 1 that comprises a movable carrier 2 provided with a drilling boom 3. The boom 3 is provided with a rock drilling unit 4 comprising a feed beam 5, a feed device 6 and a rotation unit 7. The rotation unit 7 may comprise a gear system and at least one rotating motor. The rotation unit 7 may be supported by a carriage 8 with which it is movably supported to the feed beam 5. The rotation unit 7 may be provided with drill string 9 which may comprise at least one drilling tube 10 connected to each other, and a DTH drilling assembly 11 at an outermost end of the drilling equipment 9. The DTH drilling assembly 11 is located in the drilled bore hole 12 during the drilling.

Figure 2:
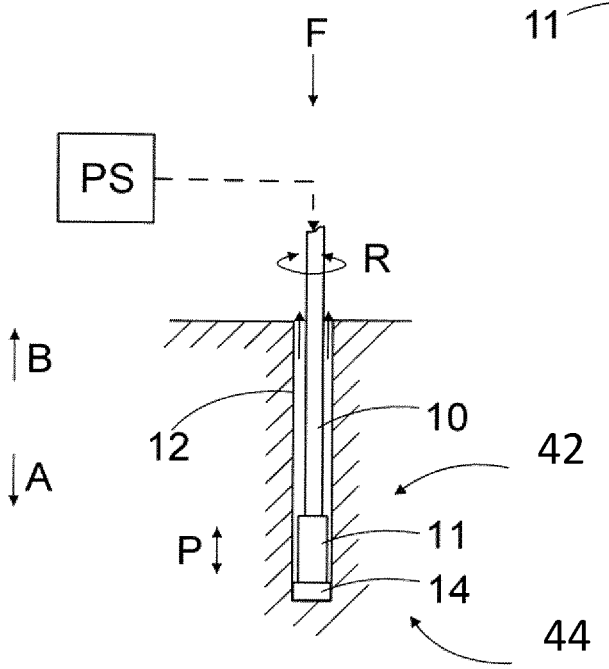
FIG. 2: shows a schematic drawing of a DTH drilling assembly at the bottom of a drill hole.

FIG. 2 shows that the DTH drilling assembly 11 comprises an impact device (not shown). The impact device is at the opposite end of the drill string 9 in relation to the rotation unit 7. During drilling, a drill bit 14 is connected directly to the impact device, whereby percussions P generated by the impact device are transmitted to the drill bit 14. The drill bit 14 is at least partially accommodated within the bottom end BE of the casing 15. The drill string 9 is rotating around its longitudinal axis in direction R by means of the rotation unit 7 shown in FIG. 1 and, at the same, the rotation unit 7 and the drill string 9 connected to it are fed with feed force F in the drilling direction A by means of the feed device 6. Then, the drill bit 14 breaks rock due to the effect of the rotation R, the feed force F and the percussion P. Pressurized fluid is fed from a pressure source PS to the drilling assembly 11 through the drilling tubes 10. The pressurized fluid may be compressed air and the pressure source PS may be a compressor. The pressurized fluid is directed to influence to working surfaces of a percussion piston 19 of the drilling assembly and to cause the piston 19 to move in a reciprocating manner and to strike against impact surface of the drill bit. After being utilized in working cycle of the drilling assembly 11 pressurized air is allowed to discharge form the drilling assembly 11 and to thereby provide flushing for the drill bit 14. Further, the discharged air pushes drilled rock material out of the drill hole in an annular space between the drill hole and the drill string 9. Alternatively, the drilling cuttings are removed from a drilling face inside a central inner tube passing through the impact device. This method is called reverse circulation drilling.

FIG. 2 indicates top end 42 or axially rearward end of the drilling assembly 11 and bottom end 44 or axially forward end of the drilling assembly.

Figure 3:
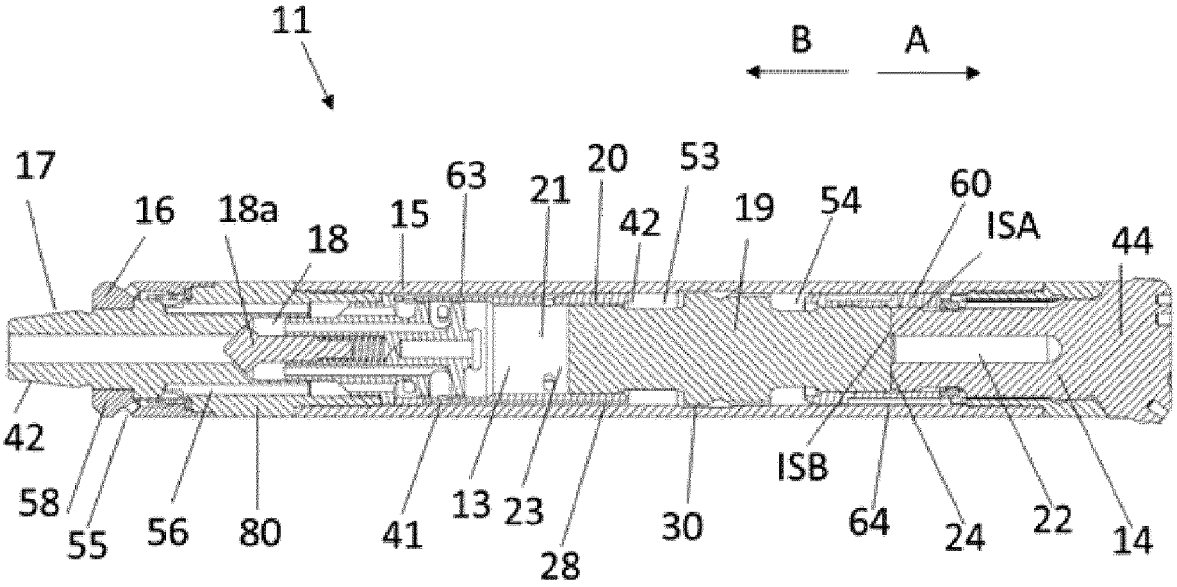
FIG. 3: shows a schematic drawing of a cross section of the DTH drilling assembly in FIG. 1.
Figure 4:
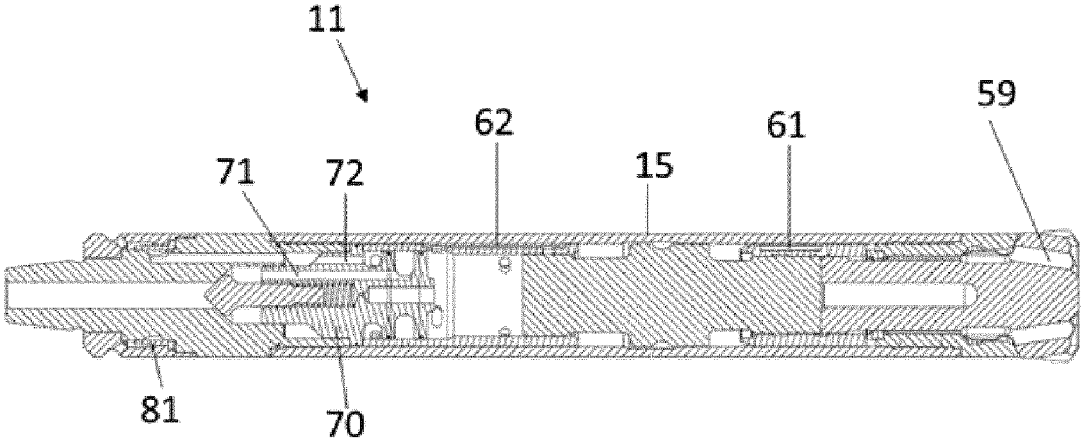
FIG. 4: shows a schematic drawing of a cross section of the DTH drilling assembly in FIG. 1 sectioned in a different plane compared to FIG. 3 to show the top and bottom feed passages.

FIGS. 3 and 4 show cross sections of a DTH drilling assembly 11 and its impact device 13. FIG. 4 has the same components as FIG. 3 but has been sectioned in a different plane compared to FIG. 3, so that additional components can be seen. The drilling assembly 11 comprises an elongate casing 15, which may be a relatively simple sleeve-like frame piece in the form of a substantially hollow cylinder. The casing 15 has outer 26 and inner 27 walls, the area inside the inner casing walls 27 forms a casing bore 33 (shown on FIG. 5). At a top end 42 of the casing 15 a top sub (or connection piece) 80 is mounted providing means for the drilling assembly 11 to be connected to a drill tube (not shown). The top sub 80 is at least partially accommodated within the top end 42 of the casing 15. An exhaust cover 16 comes above and around the top sub 80, exhaust ports 55 are formed in the top sub 80 to connect the at least one exhaust passage 56 to the exterior. A check valve 81 can be placed between the top sub 80 and the exhaust cover 16 to prevent backflow. The top sub 80 may comprise threaded connecting surfaces 17. In connection with the top sub 80 is an inlet port 18 for feeding pressurized fluid to the impact device 13. The inlet port 18 may comprise a valve means **18*a*, which allows feeding of fluid towards the impact device but prevents flow in an opposite direction. The piston 19, which is substantially an elongated cylinder extends axially within the casing 15 and is capable of shuffling back and forth longitudinally through the DTH drilling assembly 11. At a bottom end 44 of the piston 19 is an impact surface ISA arranged to strike an impact surface ISB at a top end of a drill bit 14. The piston 19 is a solid-core piece, whereby it is without any through channels or openings in the axial and transverse directions. Between the casing 15 and the piston 19 is a top control sleeve 20 and a bottom control sleeve 60. At the top end side of the piston 19 is a top working chamber 21 and at the opposite end side is a bottom working chamber 22. Movement of the piston 19 is configured to open and close fluid passages for feeding and discharging the working chambers 21, 22 and to thereby cause the piston 19 to move towards an impact direction A and return direction B. Fluid routing is executed between the inner surface of the casing 15 and an outer surface of the control sleeve 20. An outer periphery of the top control sleeve 20 and the bottom control sleeve 60 may comprise several grooves which serve as fluid passages. Transverse openings may connect the grooves to the working chambers 21,22, through the top control sleeve 20 and the bottom control sleeve 60. At the top end 42 of the drilling assembly 11 is an exhaust system 58**.

The top working chamber 21 is inside the top control sleeve 20, whereas the bottom working chamber 22 is partly defined by a central recess of the drill bit 14.

The piston 19 is at least partly inside the top control sleeve 20 and the bottom control sleeve 60. An inner diameter of the top control sleeve 20 defines the maximum outer diameter of a top end working surface 23 and the inner diameter of the bottom control sleeve 60 defines the maximum outer diameter of the bottom end working surface 24 at the distal ends of the piston 19.

Figure 5:
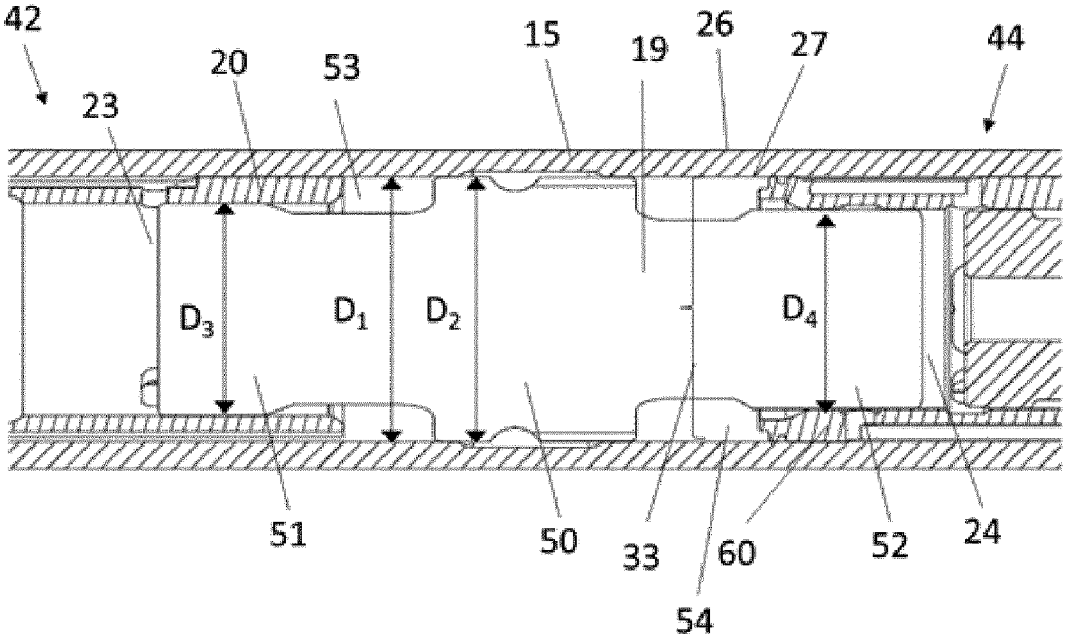
FIG. 5: shows a schematic drawing of an enlargement of the cross section of piston.

FIG. 5 shows that the piston 19 has a central portion 50 which has an outer diameter greater than that of the top and bottom working surfaces 23,24. The piston has a distal portion of the piston at the top end 51, i.e. an axially rearward end and a distal portion of the piston at the bottom end 52, i.e. an axially forward end in a longitudinal direction that are thinned with respect to the central portion of the piston 50. The drilling assembly 11 has a casing bore diameter $D_1$. The central portion 50 of the piston 19 has a diameter $D_2$, whereby $D_2$ is approximately the same as $D_1$, minus the clearance, i.e. the cross-sectional area $D_2$ of the central portion 50 of the piston 19 is equal or within 95% of cross-sectional diameter $D_1$ of the casing bore 33. The distal portion of the piston at the end top end 51 has a diameter $D_3$ and the distal portion of the piston at the bottom end 52 has a diameter $D_4$. The ratio of the diameters of the central portion 50 to the two distal portions 51, 52 is such that $D_3$ is in the range of $0.3*D_2$ to $D_2$, preferably $0.5*D_2$ to $0.98*D_2$ and $D_4$ is the range $0.3*D_2$ to $D_2$ preferably $0.5*D_2$ to $0.98*D_2$.

The cross-sectional area of the casing bore ($A_{CB}$) of the casing is defined as:

$$A_{CB} = \left(\frac{\pi}{4}\right)D_1^2$$

The top work area ($W_1$) is defined as:

$$W_1 = \left(\frac{\pi}{4}\right)D_3^2$$

The top intermediate work area ($W_2$) is defined as:

$$W_2 = \left(\frac{\pi}{4}\right)(D_2^2 - D_3^2)$$

The bottom work area ($W_3$) is defined as:

$$W_3 = \left(\frac{\pi}{4}\right)D_4^2$$

The bottom feed work area ($W_4$) is defined as:

$$W_4 = \left(\frac{\pi}{4}\right)(D_2^2 - D_4^2)$$

The cross-sectional area of the casing bore 33 is equal to the sum of the top work area ($W_1$) and the top intermediate work area ($W_2$):

$$WA_{top}+WA_{int_top}\geq 0.99*A_{CB}$$

Further, cross-sectional area of the casing bore 33 is equal to the sum of the bottom work area ($W_3$) and the bottom feed work area ($W_4$):

$$W_3+W_4\geq 0.99*A_{CB}$$

A work area is defined the effective area of the piston that will, under influence of pressurized fluid, induce a displacement of the piston.

A top intermediate chamber 53 is formed between the top end distal portion 51 of the piston 19 and the central portion 50 of the piston 19. The top intermediate chamber 53 is in fluid connection with the inlet port 18 through at least one main feed passage 28. The at least one main feed passage 28 is connected to the inlet port 18 by means of a transverse opening 41 and is connected to the top intermediate chamber 53. A bottom intermediate chamber 54 is formed between the bottom end distal portion 52 of the piston 19 and the central portion of the piston 19. The bottom intermediate chamber 54 is in fluid connection with the top intermediate chamber 53 via at least one intermediate feed passage 30, the connection is controlled by the position of the piston 19.

The top working chamber 21 is fed by conveying fluid from the top intermediate chamber 53 and through the at least one top feed passage 62, the connection is controlled by the position of the piston 19. The bottom working chamber 22 is fed by conveying fluid from the bottom intermediate chamber 54 through the at least one feed bottom passage 61. The top chamber 21 is exhausted from the top of the drilling assembly 11 through at least one exhaust port 55 located in the top end 42 of the drilling assembly to the exterior via at least one exhaust passage 56. By exhausting the top chamber 21 from the top of the hammer 42 rather than through the drill bit there is a reduction of the wear rate of the external components, including the drill bit. The bottom chamber 22 is exhausted from the bottom end 44 of the drilling assembly through at least one flushing port 59 for removing cuttings from the drill bit face.

In one embodiment, the plurality of exhaust ports 55 are always open. In other words, the exhaust passage 56 are always in fluid connection with the exhaust ports 55. In another embodiment there is a check valve (non-return valve) 81 between the exhaust ports 55 and the exhaust passage 56 to prevent backflow.

In an alternative embodiment, the exhaust system 58 is moveable axially with respect to the drill string 9 and so the at least one exhaust port 55 are able to open and close when switched between drilling mode and flushing mode. When the drilling assembly 11 is switched from drilling mode to flushing mode, the exhaust system 58 is moved forward relative to the drill string 9. The opening and closing of the exhaust port is enabled by the presence of at least one exhaust valves 57. When the drilling assembly 11 is in drilling mode the exhaust system 58 is positioned next to the drill string and so the exhaust valve 57 is positioned so that the exhaust ports 55 are open. This has the further advantage of reducing the wear of the outer components of the drilling assembly 11 during drilling. When the drilling assembly 11 is in flushing mode the exhaust system 58 is positioned forward of the drill string and therefore the at least one exhaust valves 57 are positioned so that the at least one exhaust ports 55 are closed. By closing the exhaust ports 55 when the drilling assembly 11 is in flushing mode all the air is directed through the drill bit which improves the effectiveness of the hole cleaning and prevents contamination of the hammer.

Figure 6:
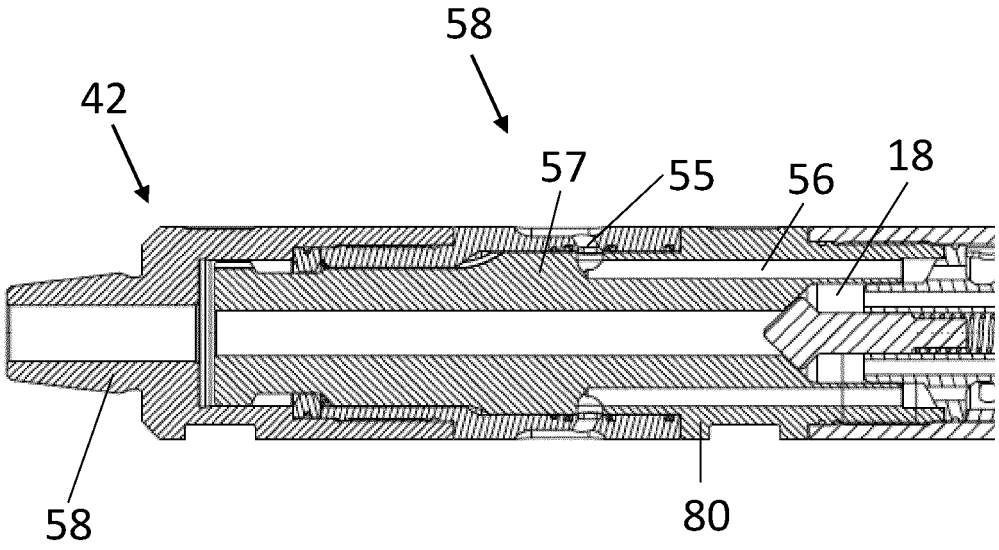
FIG. 6: shows an enlargement of the top end of the cross section of the DTH drilling assembly when in drilling mode.

FIG. 6 shows an enlargement of the top end 42 of the drilling assembly 11 when in drilling mode. In drilling mode, the exhaust valve 57 is positioned so that the at least one exhaust passage 56 and the at least one exhaust ports 55 are connected and so the pressurized fluid is exhausted to the exterior.

Figure 7:
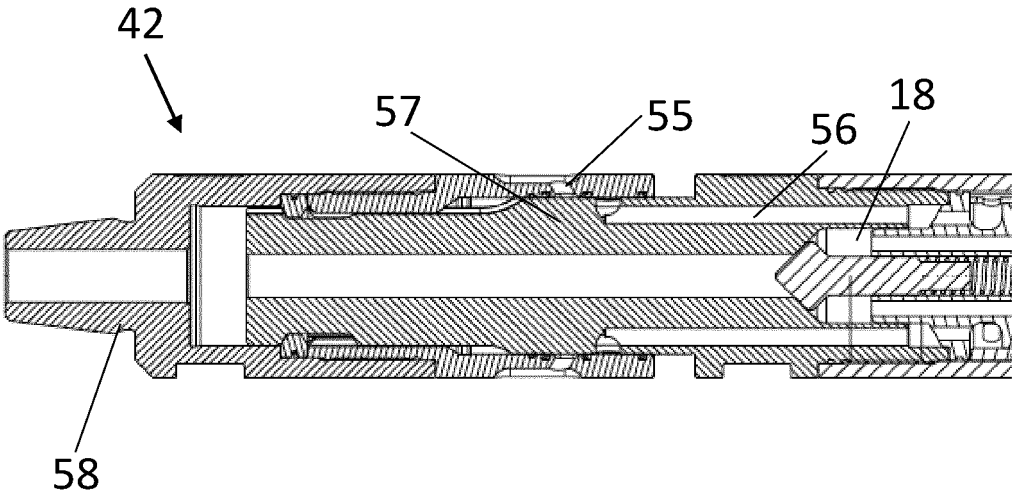
FIG. 7: shows an enlargement of the top end of the cross section of the DTH drilling assembly when in flushing mode.

FIG. 7 shows an enlargement of the top end 42 of the drilling assembly 11 when in flushing mode. In flushing mode, the exhaust valve 57 is positioned so that the at least one exhaust ports 55 are blocked off from the at least one exhaust passage 56 and the exhaust passage is blocked from the outside. This means that all the flushing air is directed through the drill bit to improve the efficiency of the hole cleaning. The position of the at least one exhaust valves 57 is controlled by the position of the drilling assembly 11 relative to the drill string 9.

The invention claimed is:

1. A down the hole drilling assembly having a top end arranged for coupling to a drill string and a bottom cutting end, the drilling assembly comprising:

an elongate casing having an outer wall and an inner wall;

a bore housed within the inner wall of the casing having an inner bore diameter $D_1$;

a fluid powered piston arranged moveably inside the casing to shuttle axially back and forth, the piston having a central portion with a cross-sectional diameter $D_2$, a top end distal portion with a cross-sectional diameter $D_3$ and a bottom end distal portion with a cross-sectional diameter $D_4$;

a top working chamber arranged at a top end of the piston;

a bottom working chamber arranged at a bottom end of the piston;

a top control sleeve and bottom control sleeve arranged inside the casing;

a plurality of fluid passages located between the top and bottom control sleeves and the casing including: at least one main feed passage, at least one top feed passage and at least one bottom feed passage arranged to control the feeding of pressurized fluid into the top and bottom working chambers to generate the reciprocating movement of the piston;

at least one flushing port at the bottom end of the casing which is connected to at least one bottom vent passage arranged to exhaust the bottom chamber;

an exhaust system including at least one exhaust port and at least one exhaust passage at the top end of the casing arranged to exhaust the top chamber via at least one top vent passage; and an air distributor having at least a first fluid passage connecting an inlet port to the at least one main feed passage and a second fluid passage connecting the top vent passage with the at least one exhaust passage, wherein the piston has a top work area ($W_1$) and a top intermediate work area ($W_2$), wherein the cross-sectional area of the casing bore ($A_{CB}$), is equal to the sum of the top work area ($W_1$) and the top intermediate work area ($W_2$), and wherein $$W_1+W_2 \geq 0.99*A_{CB}.$$

2. The down the hole drilling assembly according to claim 1, wherein the piston has a bottom work area ($W_3$) and a bottom feed work area ($W_4$), wherein a cross-sectional area of the casing bore ($A_{CB}$) is equal to the sum of the bottom work area ($W_3$) and the bottom feed work area ($W_4$), and wherein $$W_3+W_4 \geq 0.99*A_{CB}.$$

3. The down the hole drilling assembly according to claim 1, wherein the ratio of the diameters of the central portion to the two distal portions of the piston is such that:

$D_3$ is in the range $0.3*D_2$ to $D_2$; and $D_4$ is in the range $0.3*D_2$ to $D_2$.

4. The down the hole drilling assembly according to claim 1, wherein a top intermediate chamber is formed between the top end distal portion of the piston and the central portion of the piston, the top end distal portion of the piston being arranged at least partly inside the top control sleeve, and wherein the top intermediate chamber is in fluid connection with the inlet port through the at least one main feed passage.

5. The down the hole drilling assembly according to claim 4, wherein the top chamber being in fluid connection with the top intermediate chamber via the at least one top feed passage.

6. The down the hole drilling assembly according to claim 4, wherein a bottom intermediate chamber is formed between the bottom end distal portion of the piston and the central portion of the piston, and wherein the bottom end distal portion of the piston is arranged at least partly inside the bottom control sleeve, and wherein the bottom intermediate chamber is in fluid connection with the top intermediate chamber via at least one intermediate feed passage.

7. The down the hole drilling assembly according to claim 6, wherein the bottom intermediate chamber is in fluid connection with the bottom chamber via the at least one bottom feed passage.

8. The down the hole drilling assembly according to claim 1, wherein a check valve is arranged between the at least one exhaust port and the at least one exhaust passage.

9. The down the hole drilling assembly according to claim 1, wherein the exhaust system is moveable axially and there is an exhaust valve which opens and closes the connection between the at least one exhaust passage and the at least one exhaust port when the drilling assembly switches from drilling to flushing modes respectively.

10. A drilling apparatus for percussive rock drilling, the drilling apparatus comprising:

a drill string formed from a plurality of end-to-end coupled drill tubes; and a drilling assembly as claimed in claim 1 releasably attached at an axially forward end of the drill string.

* * * * *